US005290968A

United States Patent [19]

Mirigliano et al.

[11] Patent Number: 5,290,968

[45] Date of Patent: Mar. 1, 1994

[54] MAGNETIC PICKUP FOR MUSICAL INSTRUMENTS

[76] Inventors: Frank Mirigliano, 1336 Ashland St.; Richard Struzzi, 346 Concord Ave., both of Greensburg, Pa. 15601

[21] Appl. No.: 870,596

[22] Filed: Apr. 17, 1992

[51] Int. Cl.[5] ..... G10H 3/18

[52] U.S. Cl. ..... 84/726; 84/728

[58] Field of Search ..... 84/726-728

[56] References Cited

U.S. PATENT DOCUMENTS

| | | | |
|---|---|---|---|
| Re. 25,728 | 2/1965 | Freeman . | |
| 2,130,174 | 9/1938 | Beauchamp . | |
| 2,293,372 | 8/1942 | Vasilach . | |
| 2,455,046 | 11/1948 | Armond . | |
| 2,764,052 | 9/1956 | McBride . | |
| 2,896,491 | 7/1959 | Lover . | |
| 2,911,871 | 11/1959 | Schultz . | |
| 2,976,755 | 3/1961 | Fender . | |
| 3,147,332 | 9/1964 | Fender . | |
| 3,236,930 | 2/1966 | Fender . | |
| 3,541,219 | 11/1970 | Abair . | |
| 3,571,483 | 3/1971 | Davidson . | |
| 3,588,311 | 6/1971 | Zoller . | |
| 4,142,435 | 3/1979 | Pozar . | |
| 4,184,398 | 1/1980 | Siegelman . | |
| 4,188,849 | 2/1980 | Rickard | 84/726 |
| 4,372,186 | 2/1983 | Aaroe . | |
| 4,379,421 | 4/1983 | Nunan . | |
| 4,491,051 | 1/1985 | Barcus . | |
| 4,534,258 | 8/1985 | Anderson . | |
| 4,580,481 | 4/1986 | Schaller et al. . | |
| 4,581,974 | 4/1986 | Fender . | |

OTHER PUBLICATIONS

"New Pickups, New Sound. It's That Simple." Seymour Duncan, 1988, 12 pages.

"EMG Pickups" EMG, Inc. 1988 20 pages.

*Primary Examiner*—Stanley J. Witkowski

*Attorney, Agent, or Firm*—Nils H. Ljungman & Associates

[57] ABSTRACT

A magnetic pickup for musical instruments, more particularly, for stringed instruments such as an electric guitar. A plurality of individual pickups are housed in a plastic cover. Each pickup comprises a pole piece made of a ferromagnetic material which pole piece is substantially surrounded by a coil. Each coil is disposed inside a polarized permanent magnet cup and the pole pieces are arranged in a humbucking configuration. One end of each pole piece is physically connected to an alloy bar or strip wherein the bar is separated into two pieces by an air gap. The alloy bar at the top of the assembly is preferably exposed to the strings of the instrument via a slot in the top of the plastic cover.

21 Claims, 4 Drawing Sheets

MAGNETIC PICKUP FOR MUSICAL INSTRUMENTS

BACKGROUND OF THE INVENTION

1. Field of the Invention

The present invention relates to a magnetic pickup for musical instruments, more particularly, for stringed instruments such as electric guitars.

2. Background Information

A magnetic pickup essentially converts, via induction, the mechanical vibrations of the strings of the instrument into an electrical signal so that the signal can be amplified and fed to a speaker where the signal is converted to sound. Magnetic pickups are typically mounted on the body of the instrument, such as guitar, beneath the strings and at one or more points between the bridge and the neck of the guitar. Generally, a pickup comprises a permanent magnet and a magnetic circuit adapted to generate magnetic flux lines, which flux lines pass longitudinally through portions of the strings. In a pickup, wire coil is generally wound around a permanent magnet in such a manner that the vibration of the strings causes a variation in the magnetic flux which then generates an electrical signal in the coil. The electrical signal can then be amplified and fed to a speaker.

OBJECT OF THE INVENTION

The object of the present invention is to provide an improved magnetic pickup for use with stringed musical instruments.

SUMMARY OF THE INVENTION

The present invention converts mechanical string vibrations to electrical signals via a magnetic pickup which is both compact and relatively simple to construct and manufacture. The present invention further provides a smooth full range sound and improved tone quality. Additionally, uniform amplification and natural string response are achieved in the present invention.

One aspect of the invention resides broadly in a magnetic pickup for use with electrically amplified stringed musical instruments, the magnetic pickup having at least one pickup coil, the at least one pickup coil comprising: a bobbin, the bobbin comprising a magnetic pole piece and a winding of wire wound thereabout, a cylinder comprising a magnetic material, the bobbin being disposed in the cylinder, and at least one of the cylinder and the pole piece comprising a permanent magnet material.

Another aspect of the invention resides broadly in a magnetic pickup for use with electrically amplified stringed musical instruments, the magnetic pickup comprising: at least one pickup coil, the at least one pickup coil comprising a pole piece and a winding of wire wound about the pole piece, the pole piece having a longitudinal axis, the pole piece comprising a magnetic material, a bar made from ferromagnetic material, a portion of the pole piece of at least one of the at least one individual pickup coil being adjacent to the bar, the bar being disposed in a direction transverse to the longitudinal axis of the magnetic pole piece, the bar comprising a transverse slit dividing the bar into at least two portions and forming an gap between the at least two portions, and the slit being cut at a diagonal relative to the longitudinal direction of the bar.

Yet another aspect of the invention resides broadly in a magnetic pickup for use with electrically amplified stringed musical instruments, the magnetic pickup having at least one pickup coil, the pickup coil comprising: a pole piece and a winding of wire wound thereabout, an outer portion comprising a permanent magnet material, the outer portion substantially surrounding the pole piece, the pole piece comprising a ferromagnetic material having a high magnetic saturation flux density, and the pole piece having a cross sectional dimension substantially smaller than the cross sectional dimension of the outer portion.

A further aspect of the invention resides broadly in a magnetic pickup for use with electrically amplified stringed musical instruments, the magnetic pickup comprising: at least one pickup coil, the at least one pickup coil comprising a winding of wire, at least one of the at least one pickup coil having a longitudinal axis about which the winding of wire is wound, the winding of wire for having magnetic flux lines passing therethrough, and the magnetic flux lines for being generally perpendicular to a line parallel to and different from the longitudinal axis.

BRIEF DESCRIPTION OF THE DRAWINGS

One embodiment of the invention is explained below in greater detail and is illustrated in the accompanying drawings, in which.

DESCRIPTION OF THE PREFERRED EMBODIMENTS

Figure 1:
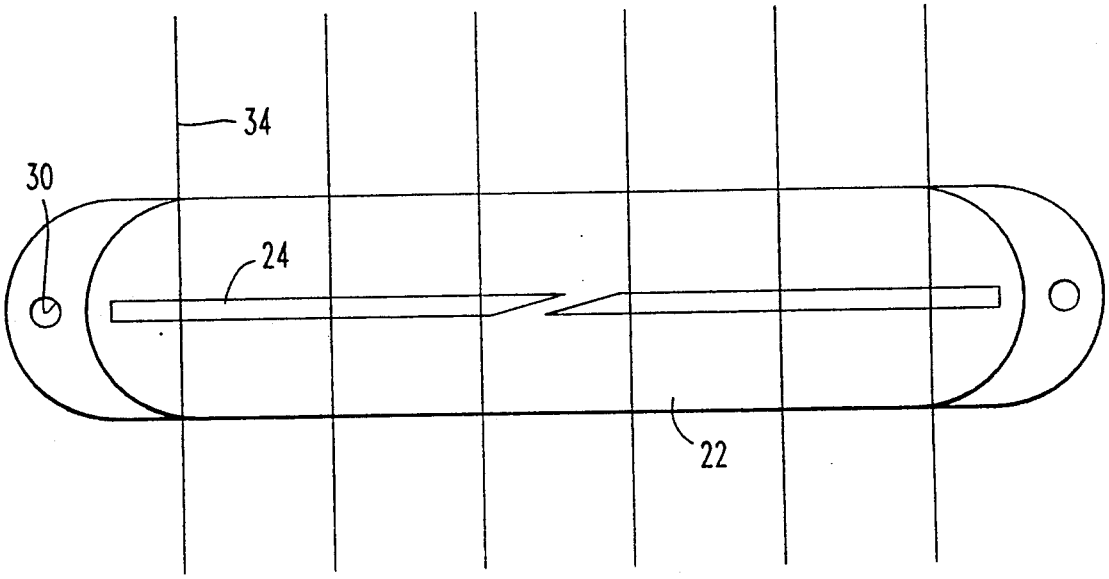
FIG. 1 is an elevational view of a magnetic pickup according to the present invention positioned under the strings of an instrument.

Preferably, as illustrated in FIG. 1, a magnetic pickup in accordance with the present invention is positioned beneath the strings 34 of a stringed instrument, such as an electric guitar, and is fastened to the body of the instrument by means of fastening holes 30. Preferably, the magnetic pickup is for being disposed sufficiently beneath the strings so as to allow for free playing of the instrument with little or no risk of the strings physically contacting any portion of the magnetic pickup.

Figure 2:
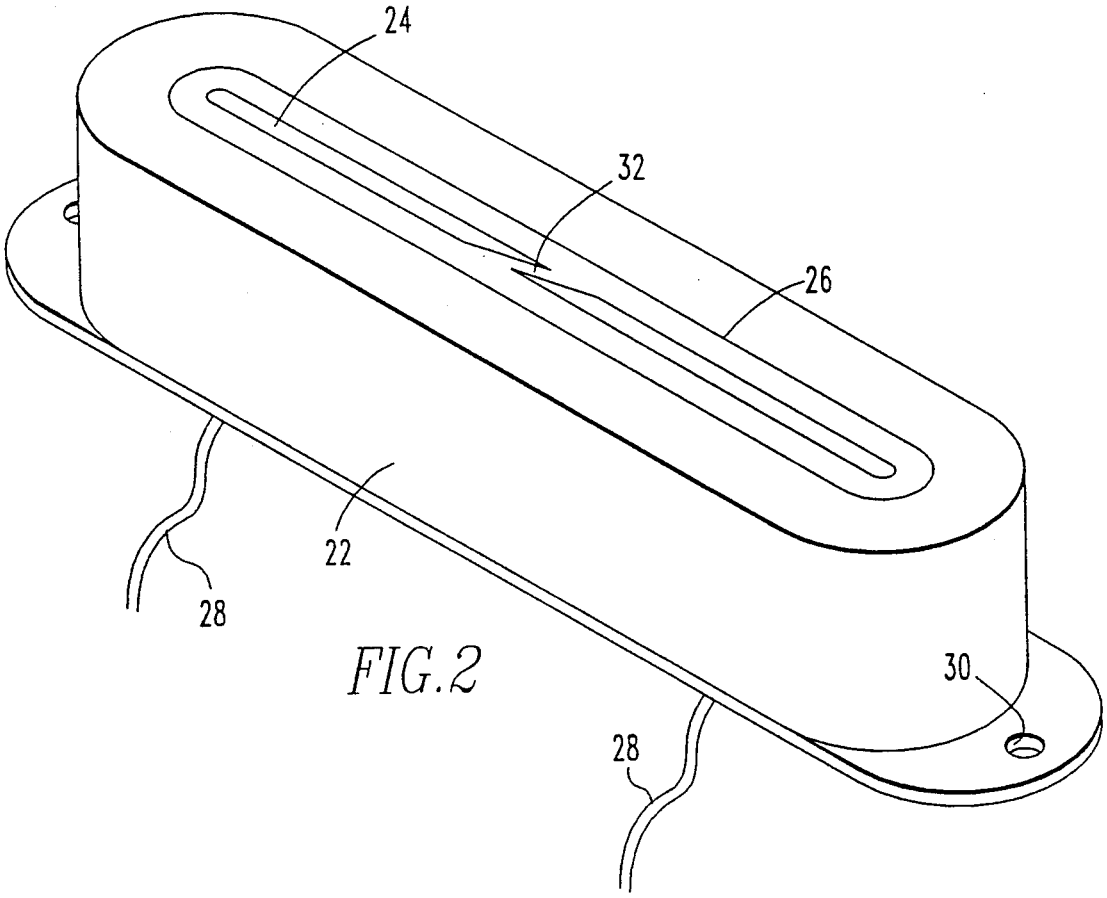
FIG. 2 is a perspective view of a magnetic pickup according to the present invention wherein individual pickups are contained within a cover.

As illustrated in FIG. 2, the magnetic pickup preferably comprises a set of individual pickups 16 housed in a cover 22. Cover 22 is preferably plastic and magnetically shielded with conductive paint.

Figure 3:
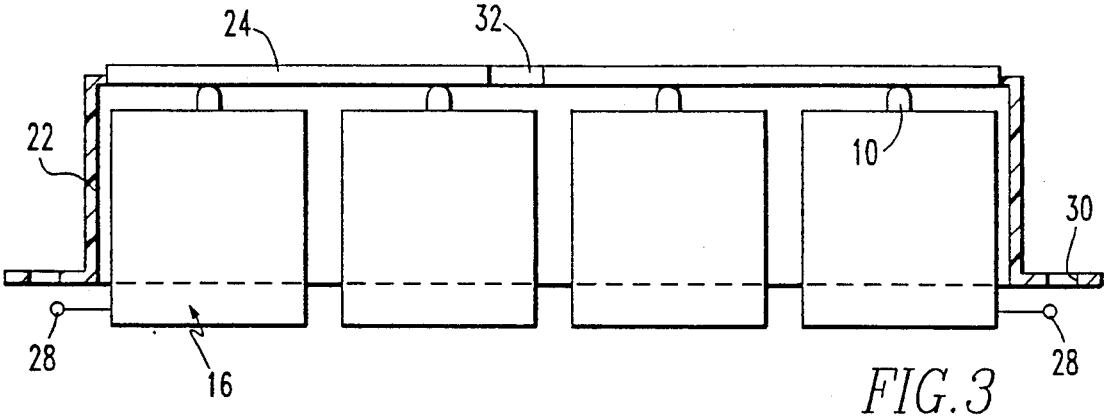
FIG. 3 is a cross sectional view of the magnetic pickup shown in FIG. 2.

In FIG. 3, which is a side view of the magnetic pickup shown in FIG. 2, the individual pickups 16 disposed in cover 22 are clearly depicted. Further, the magnetic pickup comprises AC output terminals 28, by means of which the output of the individual pickups 16 is preferably sent to an outboard amplification device where the signal is boosted and sent to a speaker wherein the signal is converted to sound.

Figure 4:
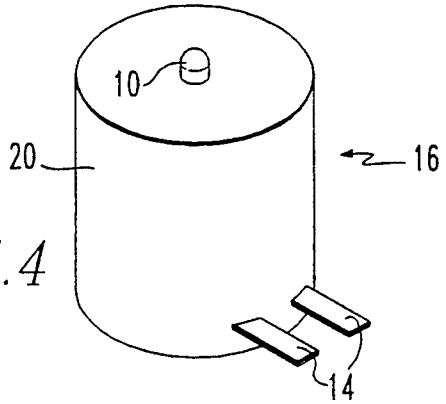
FIG. 4 is a perspective view of an individual pickup according to the present invention.

The magnetic pickup of the present invention preferably comprises at least four individual pickups 16, which individual pickups 16 are shown in FIG. 4. In one embodiment of the invention, one individual pickup 16 is disposed beneath two strings of the instrument and generally midway therebetween. For example, in such an embodiment, a magnetic pickup for a five string electric guitar would employ a total of 4 individual pickups 16, wherein one pickup 16 is disposed between each string and its adjacent string.

In another embodiment of the present invention, the number of individual pickups 16 comprising the magnetic pickup may be equal to the number of strings on the instrument. In such an embodiment, each individual pickup 16 is preferably disposed directly beneath a corresponding string of the instrument. Therefore, in such an embodiment, a magnetic pickup for a five string guitar would include 5 individual pickups 16, wherein one individual pickup is disposed directly beneath each one of the five strings. It should be understood that, generally, the present invention may be embodied by any number of individual pickups with any desired spacing therebetween in order to accommodate any stringed instrument, such as a guitar having essentially any number of strings, a banjo, or possibly even a piano.

Figure 5:
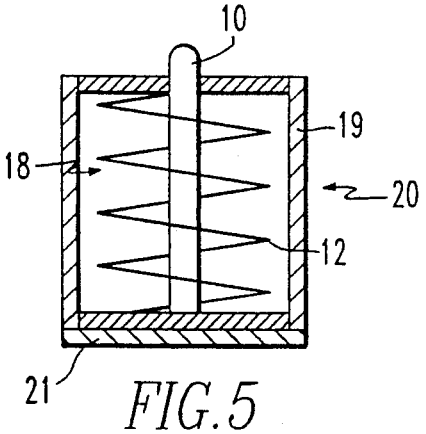
FIG. 5 is an elevational cross sectional view of an individual pickup according to the present invention.

As shown in FIG. 5, each individual pickup preferably includes a bobbin 18 disposed inside a magnetic cup 20.

Figure 5A:
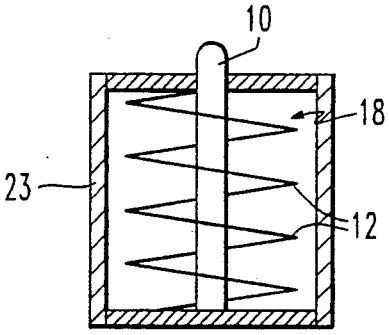
FIG. 5*a* is an elevational cross sectional view of another embodiment of the individual pickup according to the present invention.

In another embodiment of the present invention, illustrated in FIG. 5*a*, each individual pickup preferably includes a bobbin 18 disposed inside a magnetic cylinder 23.

Figure 6:
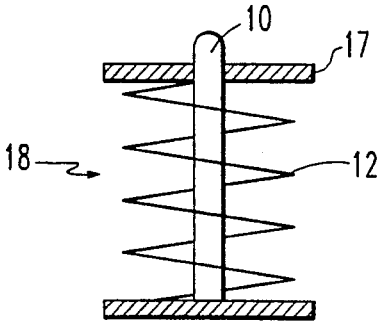
FIG. 6 shows an elevational view of a bobbin employed in accordance with the present invention.

As illustrated in FIG. 6, each bobbin 18 preferably comprises a wire coil 12 wound about a pole piece 10. The wire coil 12 preferably comprises windings of thin insulated magnet wire. Preferably, in one embodiment, a bobbin 18 may employ No. 40 wire, having 7000 turns, and provide a resistance of 700 ohms. Thus, in this embodiment, the individual pickups may preferably be wound to a high impedance yet still yield both a desirable frequency response, having a resonant frequency peak between 10 and 11 kilohertz, and a high output. Further, the lower resistance which may be attained in this embodiment is believed to lessen damping and thus contribute to a low magnetic string pull. Low magnetic string pull is desirable in that it provides more natural sustain and string response.

Each pole piece 10 is preferably is made of a ferromagnetic material. The ferromagnetic material is preferably of a high flux density type and preferably is not magnetized. Additionally, it should be understood that although the pole pieces 10 illustrated in the drawings have a generally circular cross section, a pole with a cross section of any shape, such as a square, may also be employed. In one embodiment of the present invention, a ferromagnetic pole piece 10 may be approximately 1.6 centimeters long and have a cross sectional diameter of about 4 millimeters. Further, each pole piece 10 has a free end, which is the end extending upwardly from the open end of the magnetic cup 20 and protruding through the upper bobbin piece 17. Each pole piece 10 is preferably polarized and may have either a "north" or "south" magnetic polarity.

In one embodiment of the present invention, the portion of pole piece 10 disposed below upper bobbin piece 17 may have a generally square cross section, while the portion of pole piece 10 extending upwardly through upper bobbin piece 17 may have a generally circular cross section. Thus, a pole piece 10 with several different cross sections may be employed.

Referring again to FIG. 5, magnetic cup 20 is preferably comprised of a generally cylindrical side or wall portion 19 disposed on a generally circular disk shaped bottom portion 21. However, as illustrated in FIG. 5*a*, a cylinder 23 without a bottom portion may be employed. In one embodiment, the side or wall portion 19 and the bottom portion 21 of magnetic cup 20 may be cast in one piece. In another embodiment, as in FIG. 5, the magnetic cup 20 may have two pieces, specifically a side or wall portion 19 and a bottom portion 21, which have been fastened by glue or some other fastening means.

Preferably, in one embodiment of the present invention, side or wall portion 19 may have an approximate height of 1.3 centimeters and thickness between about 1 and about 2 millimeters. Disk shaped bottom portion 21 may have a diameter of approximately 1 centimeter and also have a thickness between about 1 and about 2 millimeters. Although a disk shaped bottom portion comprising a magnetic material is depicted in the figures, the bottom portion may have a cross section of any shape, such as a square, as long as the dimension of the bottom portion is equal to or larger than the diameter of the cylindrical side or wall portion, thereby allowing the bottom portion to act as a base for the cylindrical side or wall portion.

Figure 7:
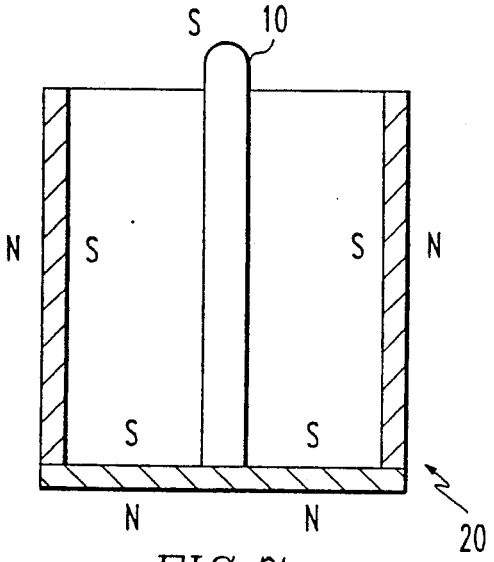
FIGS. 7 and 7*a* are a pair of elevational cross sectional views of a magnetic cup and pole piece according to the present invention, wherein magnetic polarities are schematically depicted.
Figure 7A:
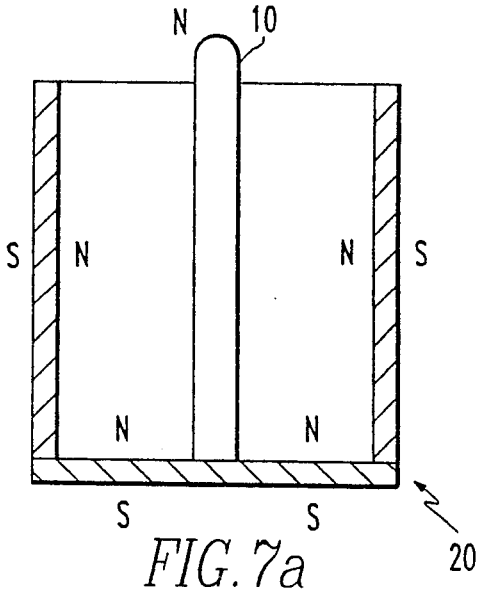
Figure 8:
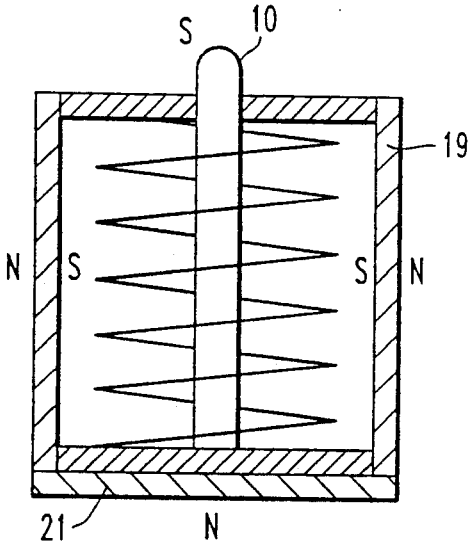
FIGS. 8 and 8*a* are substantially the same view as FIG. 7, but showing wire coil.
Figure 8A:
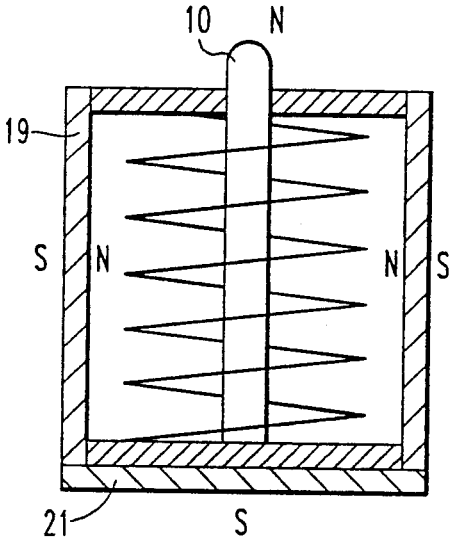

Both the wall portion 19 and bottom portion 21 are preferably constructed from a permanent magnet and are preferably polarized on each surface. One example of such a magnet is a plastiform magnet manufactured by 3M, specifically B 1033, having a thickness of 0.035 or 0.060 inches, although other magnetic materials and thicknesses may be employed. As illustrated in FIG. 7, in one embodiment of the present invention, either the outer surface of the magnetic cup 20 has a north magnetic polarity and the inner surface of the cup 20 has a south magnetic polarity, or the outer surface of the magnetic cup 20 has a south magnetic polarity and the inner surface of the cup 20 has a north magnetic polarity. The latter polarity configuration is illustrated in FIG. 8.

Figure 9:
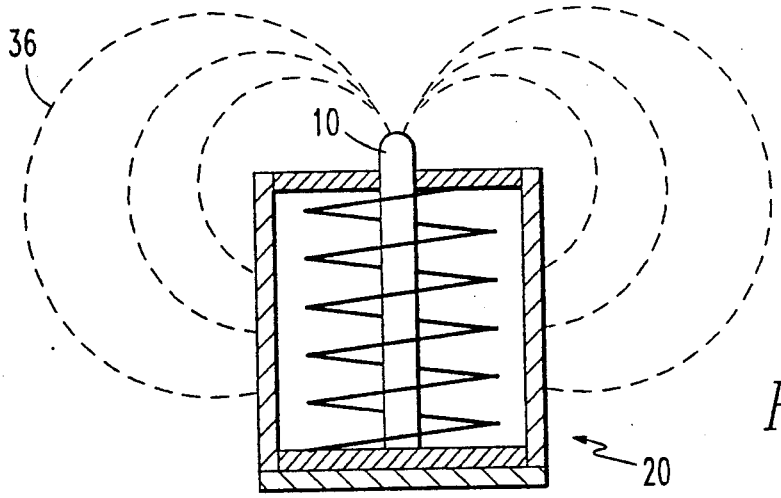
FIG. 9 is substantially the same view as FIG. 8 but additionally showing magnetic flux lines.

Further, in this embodiment, the polarity of the outer surface of the magnetic cup 20 is preferably opposite the polarity of the end of ferromagnetic pole piece 10. Such a configuration allows for a broad distribution of the magnetic field, as illustrated in FIG. 9, wherein a larger portion of a string may pass through the magnetic flux lines 36. Although not fully understood, it is believed that this configuration may result in greater sensitivity and musical response. Additionally, it is believed that in a configuration where a ferromagnetic pole piece 10 is disposed in a permanent magnet cup 20, each individual pole piece 10 may have substantially higher flux density saturation point than that exhibited in other known magnetic pickups, wherein a higher saturation point is believed to improve the overall performance of the magnetic pickup.

In the embodiment described above, pole piece 10 preferably has a high flux density and is preferably, but not necessarily, in direct contact with bottom portion 21 of permanent magnet cup 20, which has a lower flux density. It is possible, in such a configuration, that bottom portion 21 may be unable to support the magnetic flux of the pole piece 10. In this event, the bottom portion 21 of permanent magnet cup 21 may become magnetically saturated. Saturation may be prevented by employing a bottom portion 21 with a thickness about double that of the side or wall portion 19. Alternatively, two layers of permanent magnet may be placed on top of one another to form bottom portion 21, wherein each layer is of the same thickness as side or wall portion 19. Yet another alternative to prevent saturation of permanent magnet bottom portion 21 may be to imbed ferromagnetic slugs into bottom portion 21.

Yet another feature of the present invention resides in its ability to provide a smooth full range of sound with flat response and a greater harmonic content. It is believed that this feature may be attributed to a high resonant peak. By employing a ferromagnetic pole piece 10, wherein ferromagnetic materials have a high saturation flux density relative to permanent magnet materials, the pole piece 10 may be constructed with a diameter substantially smaller than that of a permanent magnet pole piece having a lower saturation flux density. Utilizing a smaller pole piece 10 enables the wire coils 12 to be wound more tightly, which in turn may lower the capacitance and thereby yield a higher resonant frequency. It is further believed that surrounding the coil with a magnetic material may increase the resonant frequency.

As illustrated in FIG. 4, each individual pickup 16 also usually includes two output leads 14. In the present embodiment, the mechanical vibrations of a steel guitar string disturb the magnetic field set up by the magnetic pole piece 10 and the magnetic cup 20. FIG. 9 shows the magnetic flux lines 36 of the magnetic field. The disturbance of the magnetic field then generates, via magnetic induction, a voltage in wire coil 12. Output leads 14, which extend from the magnetic cup 20, are used to measure the voltage generated in coil 12.

Figure 10:
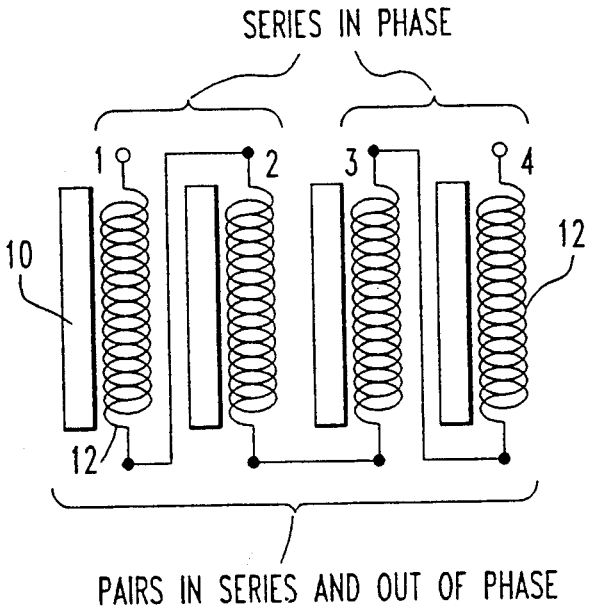
FIG. 10 is a schematic representation of a humbucking configuration according to the present invention.

As shown in FIG. 10, within cover 22, the at least four individual pickups 16 of the present invention are preferably connected to one another in series. Such a coil configuration, as shown in FIG. 10, is well known in the art as a "humbucking" configuration. In one embodiment, as in FIG. 10, coils 1 and 2 constitute a first associated pair connected in series, have pole pieces 10 of the same polarity (south) and are in phase with one another. Coils 3 and 4 constitute a second associated pair and thus are also connected in series, have pole pieces with polarity (north) opposite the polarity of the first pair, and are in phase with one another. The first pair of coils is connected in series with the second pair of coils, wherein the first pair is out of phase with the second pair and thus the pairs interfere destructively. In other words, the interference induced in one pair of coils is cancelled by the interference induced in the other pair of coils. Thus, such a configuration allows for the elimination of signals produced by extraneous sources without resulting in substantial damping or attenuation of signals produced by string vibration.

As shown in FIG. 3, in addition to the coils 12 being connected in series, the ends of the pole pieces 10 disposed in coils 12 are held in mechanical contact, preferably by press fitting or possibly by soldering, to an alloy or iron bar 24. The surface of alloy bar 24 is preferably exposed to the strings through slot 26 in cover 22. Such a configuration is also illustrated in FIG. 2. In the present embodiment, the pole piece ends of the first pair of coils are connected to a first side of the alloy bar and the pole piece ends of the second pair are connected to a second side of the alloy bar 24. The first and second sides of alloy bar 24 are preferably separated by an air gap 32, or by any material having the same permeability as air, such as epoxy resin. One example of an alloy material which may be employed is Permalloy manufactured by Spang, although other alloys may be used.

Figure 11:
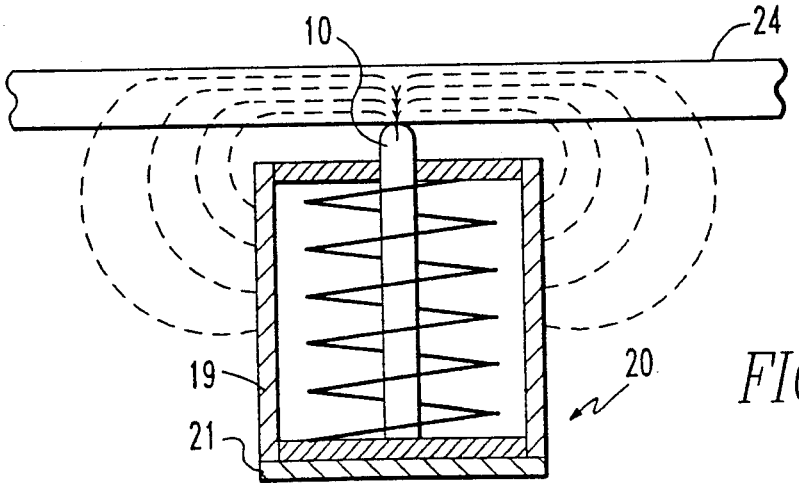
FIG. 11 is an elevational cross sectional view of a magnetic cup, pole piece and alloy bar according to the present invention, wherein magnetic flux lines are schematically depicted.

Although not fully understood, use of the alloy bar may achieve a substantially more uniform distribution of the magnetic flux. The magnetic flux lines, in the embodiment of the present invention employing an alloy bar, are illustrated in FIG. 11. It is further believed that the benefits provided by the alloy bar may be twofold.

First, as illustrated in FIG. 11, a more uniform distribution of the magnetic flux through the alloy bar may be attained. Thus, each string may pass through an area with a generally equivalent flux density. This feature may result in substantially equal response to each string and may thereby reduce distortion.

Second, by maintaining a substantially uniform magnetic flux distribution across the alloy bar, the number of individual pickups 16 may not need to be adjusted to accommodate different numbers of strings 34. In other words, because a generally uniform magnetic flux is maintained across the alloy bar 24, an individual pickup 16 may not necessarily need to be placed directly beneath or between each of the instrument strings. Therefore, in such an embodiment, 4 individual pickups may be adequate for 6 or more strings.

Thus, it is believed that use of the alloy bar 24 may create a more uniform distribution of the magnetic flux. It is further believed that a more uniform flux distribution may enhance the response of the magnetic pickup. Further, by employing an alloy bar 24 with a more uniform magnetic flux density, fewer individual pickups 16 may be required to obtain high quality output.

Air gap 32 is provided to prevent the magnetic pickup from acting as a short circuit magnetic loop, and accordingly would therefore offer no electrical loading on the circuit associated with the electromagnetic coils enclosed therein. Moreover, the configuration of the air gap 32 in the present invention provides a distinct advantage. In one embodiment, the air gap 32 is a slit disposed perpendicularly in relation to the lengthwise orientation of the magnetic pickup. In such a configuration, one or more strings 34 may be positioned generally directly above the air gap 32, thus the output corresponding to these strings may either be distorted or less sensitive than that of the other strings not positioned over an air gap 32.

In one embodiment of the present invention, the air gap 32 is not a slit disposed perpendicularly in relation to the lengthwise orientation of the magnetic pickup, but is preferably cut at a diagonal relative to the transverse direction of the magnetic pickup. In this diagonal configuration, no one string 34 is disposed entirely above an air gap 32, which could render the string musically unresponsive. In other words, every string on the instrument passes over some portion of the alloy bar 24, thus enabling a more uniform response and amplification of all the strings.

Other magnetic pickups which may be used in conjunction with the present invention can be found in a catalogue entitled *PICKUPS*, published in 1988 by Seymour Duncan, 601 Pine Avenue, Santa Barbara, Calif. 93117. Additional magnetic pickups which may be encorporated with the present invention appear in the 1988 *PICKUPS* catalogue, published by EMG, Inc., P.O. Box 4394, Santa Rosa, Calif. 95402.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A magnetic pickup for use with electrically amplified stringed musical instruments, said magnetic pickup having at least one pickup coil, said at least one pickup coil comprising:

a bobbin;

said bobbin comprising a magnetic pole piece and a winding of wire wound thereabout, said bobbin having an exterior surface;

a cylinder comprising a magnetic material;

said bobbin being disposed in said cylinder with the magnetic material of said cylinder disposed adjacent the exterior surface of said bobbin; and at least one of said cylinder and said pole piece comprising a permanent magnetic material.

2. The magnetic pickup of claim 1 wherein said cylinder comprises:

a base portion disposed on one end thereof;

said base portion comprising a magnetic material;

said base portion and said cylinder defining a cup;

said bobbin being disposed in said cup; and at least one of said cup and said pole piece comprising a permanent magnet material.

3. The magnetic pickup of claim 2 wherein said cylinder has a circular cross section.

4. The magnetic pickup according to claim 3, wherein:

at least one pickup coil comprises at least one first pickup coil and at least one second pickup coil, said at least one first pickup coil being spaced apart from said at least one second pickup coil;

the wire wound around said at least one first pickup coil is serially connected to the wire wound around said at least one second pickup coil;

said magnetic pickup additionally comprises a bar disposed from at least said at least one first pickup coil to said at least one second pickup coil;

said bar comprising a feromagnetic material; and a portion of said pole piece of each of said at least one first pickup coil and said at least one second pickup coil being disposed in contact with said bar.

5. The magnetic pickup according to claim 4, wherein:

said at least one first pickup coil and said at least one second pickup coil each comprise a magnetic polarity, and the magnetic polarity of said at least one first pickup coil is reversed with respect to the magnetic polarity of said at least one second pickup coil such that said at least one first pickup coil and said at least one second pickup coil are out of phase;

said bar comprises a transverse slit dividing said bar into a first portion and a second portion, the transverse slit defining a space between said first portion and said second portion;

said first portion being disposed in contact with said portion of said pole piece of said at least one first pickup coil and said second portion being disposed in contact with said portion of said pole piece of said at least one second pickup coil.

6. The magnetic pickup according to claim 5, wherein:

said cylinder comprises a permanent magnet material;

said pole piece comprises a ferromagnetic material having a high magnetic saturation flux density;

said pole piece has a cross-sectional dimension substantially less than a cross-sectional dimension of said cylinder;

each of said at least one first pickup coil and said at least one second pickup coil comprises at least two pickup coils wired in phase with one another;

said at least two first pickup coils being connected in series with one another;

said at least two second pickup coils being connected in series with one another;

said space between said first and second portions of said bar is filled with one of:

air; and a material having a magnetic permeability substantially the same as air;

the material having a magnetic permeability substantially the same as air comprising an epoxy resin;

each of said first and second pickup coils is disposed in alignment with the other pickup coils within a rigid plastic housing;

the rigid plastic housing having a longitudinal slot therein;

said portion of said pole piece for contacting said bar of each of said first and second pickup coils being disposed through said longitudinal slot of said plastic cover;

said plastic cover comprises a conductive paint coating for shielding said plastic cover;

the wire comprises an insulated magnet wire;

the bar comprises at least one of:

iron; and alloy metal;

the alloy metal comprising PERMALLOY;

said portion of said pole piece for contacting said bar being permanently connected to said bar;

said permanent connection comprising a solder connection;

said cylinder has a portion disposed towards said winding;

said base portion has a portion disposed towards said winding;

said cylinder portion disposed towards said winding and said base portion disposed towards said winding having matching magnetic polarities; and said transverse slit of said bar being disposed diagonally relative to a longitudinal axis of said bar.

7. A magnetic pickup for use with electrically amplified stringed musical instruments, said magnetic pickup comprising:

at least one pickup coil;

said at least one pickup coil comprising a pole piece and a winding of wire wound about said pole piece, said pole piece having a longitudinal axis;

said pole piece comprising a magnetic material;

said bar made from ferromagnetic material;

a portion of said pole piece of at least one of said at least one pickup coil being adjacent to said bar;

said bar being disposed in a direction transverse to said longitudinal axis of said magnetic pole piece;

said bar comprising a transverse slit dividing said bar into at least two portions and forming an gap between said at least two portions; and said slit being cut at a diagonal relative to a longitudinal direction of said bar.

8. The magnetic pickup according to claim 7, wherein:

said at least one pickup coil comprises at least one first pickup coil and at least one second pickup coil, said at least one first pickup coil and said at least one second pickup coil being disposed spaced apart from one another in said direction transverse to said longitudinal axis of said magnetic pole piece;

said at least one first pickup coil and said at least one second pickup coil each comprise a magnetic polarity, and the magnetic polarity of said at least one first pickup coil is reversed with respect to the magnetic polarity of said at least one second pickup coil such that said at least one first pickup coil and said at least one second pickup coil are out of phase;

said at least two portions of said bar comprise a first portion and a second portion;

said first portion being disposed in contact with said portion of said pole piece of said at least one first pickup coil and said second portion being disposed in contact with said portion of said pole piece of said at least one second pickup coil.

9. The magnetic pickup according to claim 8, wherein:

each of said at least one first pickup coil and said at least one second pickup coil comprises at least two pickup coils wired in phase with one another;

said at least two first pickup coils being connected in series with one another;

said at least two second pickup coils being connected in series with one another;

each of said at least one first pickup coil and said at least one second pickup coil comprise:

a cylinder disposed about the wire winding; and a base portion disposed opposite said portion of said pole piece in contact with said bar;

said cylinder and said base portion comprising a magnetic material; and at least one of:

said cylinder and said base portion; and said pole piece comprising permanent magnetic material.

10. The magnetic pickup according to claim 9, wherein:

said cylinder and said base portion comprise a permanent magnet material;

said pole piece comprises a ferromagnetic material having a high magnetic saturation flux density; and said pole piece has a cross-sectional dimension substantially less than a cross-sectional dimension of said cylinder.

11. The magnetic pickup according to claim 10, wherein:

said cylinder has a portion disposed towards said winding;

said base portion has a portion disposed towards said winding; and said cylinder portion disposed towards said winding and said base portion disposed towards said winding having matching magnetic polarities.

12. The magnetic pickup according to claim 11, wherein:

said gap between said at least two portions of said bar is filled with one of:

air; and a material having a magnetic permeability substantially the same as air;

the material having a magnetic permeability substantially the same as air comprising an epoxy resin;

each of said first and second pickup coils is disposed in alignment with the other pickup coils within a rigid plastic housing;

the rigid plastic housing having a longitudinal slot therein;

said portion of said pole piece for contacting said bar of each of said first and second pickup coils being disposed through said longitudinal slot of said plastic cover;

said plastic cover comprises a conductive paint coating for shielding said plastic cover;

the wire comprises an insulated magnet wire;

the bar comprises at least one of:

iron; and alloy metal;

the alloy metal comprising PERMALLOY;

said portion of said pole piece for contacting said bar being permanently connected to said bar; and said permanent connection comprising a solder connection.

13. A magnetic pickup for use with electrically amplified stringed musical instruments, said magnetic pickup having at least one pickup coil, said at least one pickup coil comprising:

a pole piece and a winding of wire wound thereabout;

an outer portion comprising a cylinder of a permanent magnet material, said cylindrical outer portion surrounding said pole piece and said winding;

said pole piece comprising a ferromagnetic material having a high magnetic saturation flux density; and said pole piece having a cross sectional dimension substantially smaller than a cross sectional dimension of said outer portion.

14. The magnetic pickup according to claim 13, wherein:

said at least one pickup coil comprises at least one first pickup coil and at least one second pickup coil, said at least one first pickup coil being spaced apart from said at least one second pickup coil;

the wire wound around said at least one first pickup coil is serially connected to the wire wound around said at least one second pickup coil;

said magnetic pickup additionally comprises a bar disposed from at least said at least one first pickup coil to said at least one second pickup coil;

said bar comprising a ferromagnetic material; and a portion of said pole piece of each of said at least one first pickup coil and said at least one second pickup coil being disposed in contact with said bar.

15. The magnetic pickup according to claim 14, wherein:

said at least one first pickup coil and said at least one second pickup coil each comprise a magnetic polarity, and the magnetic polarity of said at least one first pickup coil is reversed with respect to the magnetic polarity of said at least one second pickup coil such that said at least one first pickup coil and said at least one second pickup coil are out of phase;

said bar comprises a transverse slit dividing said bar into a first portion and a second portion, the transverse slit defining a space between said first portion and said second portion;

said first portion being disposed in contact with said portion of said pole piece of said at least one first pickup coil and said second portion being disposed in contact with said portion of said pole piece of said at least one second pickup coil.

16. The magnetic pickup according to claim 15, wherein:

each of said at least one first pickup coil and said at least one second pickup coil comprises at least two pickup coils wired in phase with one another;

said at least two first pickup coils being connected in series with one another;

said at least two second pickup coils being connected in series with one another;

said outer portion comprises:

a cylinder disposed about the wire winding; and a base disposed opposite said portion of said pole piece for contacting said bar;

said base portion and said cylinder defining a cup;

said cylinder has a portion disposed towards the winding;

said base portion has a portion disposed towards the winding; and said cylinder portion disposed towards the winding and said base portion disposed towards the winding have matching magnetic polarities.

17. A magnetic pickup for use with electrically amplified stringed musical instruments, said magnetic pickup comprising:

at least one pickup coil;

said at least one pickup coil comprising a winding of wire;

at least one of said at least one pickup coil having a longitudinal axis about which said winding of wire is wound;

said at least one pickup coil having an exterior surface thereabout, the exterior surface being substantially parallel to said longitudinal axis;

said winding of wire for having magnetic flux lines passing therethrough; and 'the magnetic flux lines for being generally perpendicular to the exterior surface at substantially all sides of the exterior surface.

18. The magnetic pickup of claim 17 wherein:

said winding of wire is wound about a pole piece;

said magnetic flux lines pass through said winding of wire and are substantially perpendicular to said pole piece.

19. The magnetic pickup according to claim 17, wherein:

said at least one pickup coil further comprises an outer cylindrical portion comprising a permanent magnetic material, said outer portion substantially surrounding said pole piece and said wire winding;

said pole piece comprising a ferromagnetic material having a high magnetic saturation flux density;

said at least one pickup coil comprises at least one first pickup coil and at least one second pickup coil, said at least one first pickup coil being spaced apart from said at least one second pickup coil;

the wire wound around said at least one first pickup coil is serially connected to the wire wound around said at least one second pickup coil;

said magnetic pickup additionally comprises a bar disposed from at least said at least one first pickup coil to said at least one second pickup coil;

said bar comprising a ferromagnetic material; and a portion of said pole piece of each of said at least one first pickup coil and said at least one second pickup coil being disposed in contact with said bar.

20. The magnetic pickup according to claim 19, wherein:

said at least one first pickup coil and said at least one second pickup coil each comprise a magnetic polarity, and the magnetic polarity of said at least one first pickup coil is reversed with respect to the magnetic polarity of said at least one second pickup coil such that said at least one first pickup coil and said at least one second pickup coil are out of phase;

said bar comprises a transverse slit dividing said bar into a first portion and a second portion, the transverse slit defining a space between said first portion and said second portion;

said first portion being disposed in contact with said portion of said pole piece of said at least one first pickup coil and said second portion being disposed in contact with said portion of said pole piece of said at least one second pickup coil.

21. The magnetic pickup according to claim 20, wherein:

each of said at least one first pickup coil and said at least one second pickup coil comprises at least two pickup coils wired in phase with one another;

said at least two first pickup coils being connected in series with one another;

said at least two second pickup coils being connected in series with one another;

said outer portion comprises:

a cylinder disposed about the wire winding; and a base disposed opposite said portion of said pole piece for contacting said bar;

said base portion and said cylinder defining a cup;

said cylinder has a portion disposed towards the winding;

said base portion has a portion disposed towards the winding; and said cylinder portion disposed towards the winding and said base portion disposed towards the winding have matching magnetic polarities.

* * * * *